US005988531A

United States Patent [19]

Maden et al.

[11] Patent Number: 5,988,531

[45] Date of Patent: Nov. 23, 1999

[54] METHOD OF MAKING A FUEL INJECTOR

[75] Inventors: Ken Maden, Coronado; John Lockyer, Lajolla, both of Calif.

[73] Assignee: Solar Turbines, San Diego, Calif.

[21] Appl. No.: 08/977,772

[22] Filed: Nov. 25, 1997

[51] Int. Cl.[6] ..... B05B 7/06; F02C 1/00

[52] U.S. Cl. ..... 239/406; 239/419; 239/425.5; 239/600; 60/740

[58] Field of Search ..... 239/423–425.5, 239/420, 416.5, 417.3, 419, 403–406, 600; 60/737, 740

[56] References Cited

U.S. PATENT DOCUMENTS

| | | | |
|---|---|---|---|
| 3,652,016 | 3/1972 | Cheshire | 239/424.5 |
| 3,741,483 | 6/1973 | Kawaguchi | 239/424.5 X |
| 3,764,071 | 10/1973 | Carlisle | 239/424.5 X |
| 3,824,051 | 7/1974 | Van Leemput | 425/78 |
| 3,940,104 | 2/1976 | Hermes et al. | 249/142 |
| 4,773,596 | 9/1988 | Wright et al. | 239/424.5 |
| 4,938,909 | 7/1990 | Daly | 264/219 |
| 5,111,794 | 5/1992 | DeGrace, Jr. | 123/470 |
| 5,168,625 | 12/1992 | DeGrace, Jr. | 29/888.01 |
| 5,381,963 | 1/1995 | Bright et al. | 239/533.2 |
| 5,474,119 | 12/1995 | Jonsson | 164/137 |

FOREIGN PATENT DOCUMENTS

| | | | |
|---|---|---|---|
| 2910464 | 9/1979 | Germany | 239/424.5 |

*Primary Examiner*—Kevin Weldon
*Attorney, Agent, or Firm*—Larry G. Cain

[57] ABSTRACT

Present fuel injectors fail to be cost effective and with the complexity of recent fuel injectors tend to be labor intensive. The present fuel injector and method of making the fuel injector provides a cost effective fuel injector which reduces the labor intensiveness of manufacturing. The manufacturing of the fuel injector includes the separate formation of a first unitary component, a second unitary component and a third unitary component by individual castings. The unitary components are positioned relative one to another and welded forming the fuel injector having a preestablished configuration. The unitary components are individually cast and each include an as cast complex configuration verses a plurality of individual components being welded in subassemblies and into a final assembly.

25 Claims, 6 Drawing Sheets

36
12
30
48
50
44
46
76
10
42
34
38
40
60
92
14
32
98
250
80
260
164
18
100
99
282
68
62
70
262
74
264
16

12
36
30
50
48
44
46
76
42
34
38
40
60
32
66
64
68
282
62
70
72
74

METHOD OF MAKING A FUEL INJECTOR

TECHNICAL FIELD

This invention relates generally to a gas turbine engine and more particularly to a fuel injector and a method of making the fuel injector.

BACKGROUND ART

Gas turbine engines utilize fuel injectors for supplying fuel to a combustor. In the combustor, the fuel and air are ignited and burned. From the combustor, the hot gaseous fluids are directed to a turbine resulting in rotation of the turbine and an output power. The spent fluid results in an exhaust emitted from the engine.

The use of fossil fuel in gas turbine engines results in combustion products within the exhaust. These combustion products consist of carbon dioxide, water vapor, oxides of nitrogen, carbon monoxide, unburned hydrocarbons, oxides of sulfur and particulates. Of these above products, carbon dioxide and water vapor are generally not considered objectionable. In most applications, governmental imposed regulations are further restricting the remainder of the species, mentioned above, emitted in the exhaust gases.

The majority of the products of combustion emitted in the exhaust can be controlled by design modifications, cleanup of exhaust gases and/or regulating the quality of fuel used. For example, particulates in the engine exhaust have been controlled either by design modifications to the combustor and fuel injectors or by removing them by traps and filters.

Thus, the design and modifications of the fuel injectors have become more complex. Furthermore, the consistency of manufacturing to insure the commonality of fuel injectors and the repeatability of emissions has become more and more important. For example, the multiplicity of parts, such as, swirlers, cooled tips, spooked gaseous components, liquid fuel passages, gaseous fuel passages, water passages, air induction passages, etc. are examples of such complex components or parts. Historically, the manufacturing of fuel injector are labor intensive. For example, most of the fuel injectors have been fabricated from many accurately machined components. The components used for making up the fuel injectors require tedious locating and placement of the individual components one with respect to another in a very precise manner. After being properly positioned, the application of a weld material and flux is required. And, the furnace brazing of the component parts to produce a finished fuel injector is completed. In many applications, several furnace brazing operations are required. As an example, three or four different brazing operation may have to be performed at different times to gradually build up the injector assembly. This process may take typically two to three week for the assembly and test after each stage of brazing.

Additionally, the quality of fuel injectors influences servicing time and costs. A higher quality of fuel injector will reduce service time resulting in reduced costs. And, a higher quality of fuel injector will make for a more efficient gas turbine engine resulting in reduced emissions.

The present invention is directed to overcome one or more of the problems as set forth above.

DISCLOSURE OF THE INVENTION

In one aspect of the invention, a fuel injector is adapted for use with a gas turbine engine. The fuel injector is comprised of a first unitary component defining a body portion having a mounting portion thereon and a fuel passage positioned therein; a second unitary component defines a barrel portion having a first end portion and a second end portion. The first end portion is fixedly attached to the first unitary component and the second end portion has a nozzle end portion formed as a unitary portion of the second unitary component. The nozzle end portion defines a combustor face portion having a plurality of fuel distribution passages therein and a plurality of swirlers are positioned about the combustor face portion. And, the fuel injector further includes, a third unitary component defining a cylindrical body having a first end, a second end and a passage extending between each of the first end and the second end. A first raised portion is positioned between the first end and a second raised portion is positioned between the first raised portion and the second end. A cavity is formed between the first radial portion and the second radial portion. The cavity is in communication with the passage and the fuel passage. The third unitary component is fixedly attached to the first unitary component.

In another aspect of the invention, a method of making a fuel injector includes the steps of:

manufacturing a first unitary component defining a first body portion defining an axis and having a mounting portion positioned thereon and a fuel passage positioned therein, and a method of manufacturing being a casting process; manufacturing a second unitary component defining a barrel portion having a first end portion and a second end portion, an axis extending between the first end portion and the second end portion, and the second end portion having a nozzle end portion attached thereto. The nozzle end portion defines a combustor face portion having a plurality of fuel distribution passages therein and a plurality of swirlers are positioned about the combustor face. And, a method of manufacturing the second unitary component being a casting process. And, the step of manufacturing a third unitary component defining a cylindrical body having a first end and a second end, a passage extending between each of the first end and the second end, a first raised portion being positioned between the first end and a second raised portion being positioned between the first raised portion and the second end, a cavity being formed between the first radial portion and the second radial portion. The cavity is in communication with the passage, and a method of manufacturing the third unitary component being a casting process. And, the further step of attaching the first unitary component, the second unitary component and the third unitary component into the fuel injector having a predetermined fixed configuration.

In another aspect of the invention, a fuel injector is comprised of a first unitary component being manufactured by a casting process; a second unitary component being manufactured by a casting process; a third unitary component being manufactured by a casting process; and the second unitary component being positioned within the first unitary component, the third unitary component being positioned within the first unitary component and the second unitary component being fixedly attached to the first unitary component and the third unitary component being fixedly attached to the first unitary component.

BRIEF DESCRIPTION OF THE DRAWINGS

FIG. 5 is an enlarged detailed sectional view of a portion of the fuel injector.

BEST MODE FOR CARRYING OUT THE INVENTION

Figure 1:
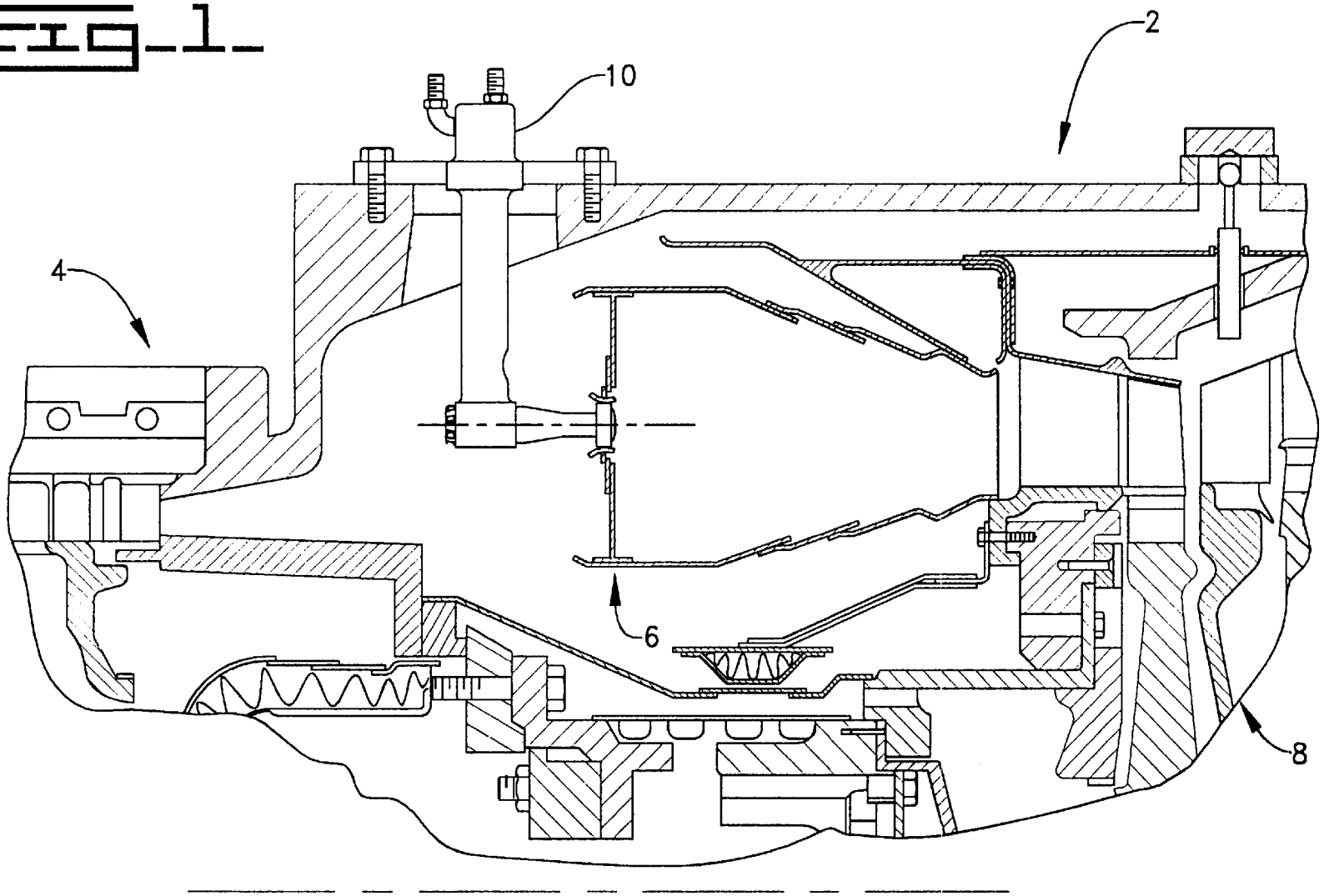
FIG. 1 is a pictorial view of a gas turbine engine embodying the present invention.
Figure 2:
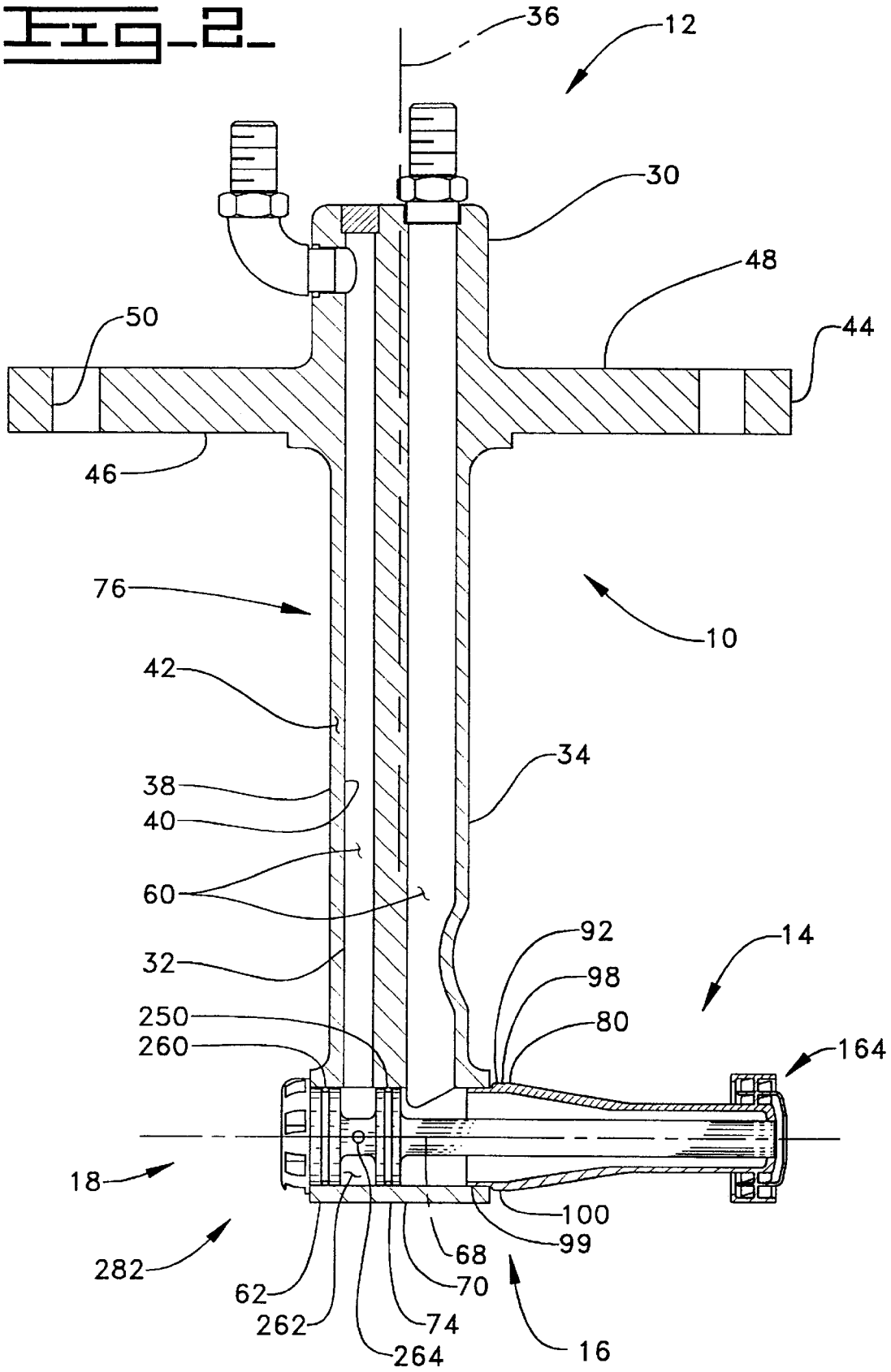
FIG. 2 is a pictorial view of a fuel injector adapted for use with the gas turbine engine.
Figure 3:
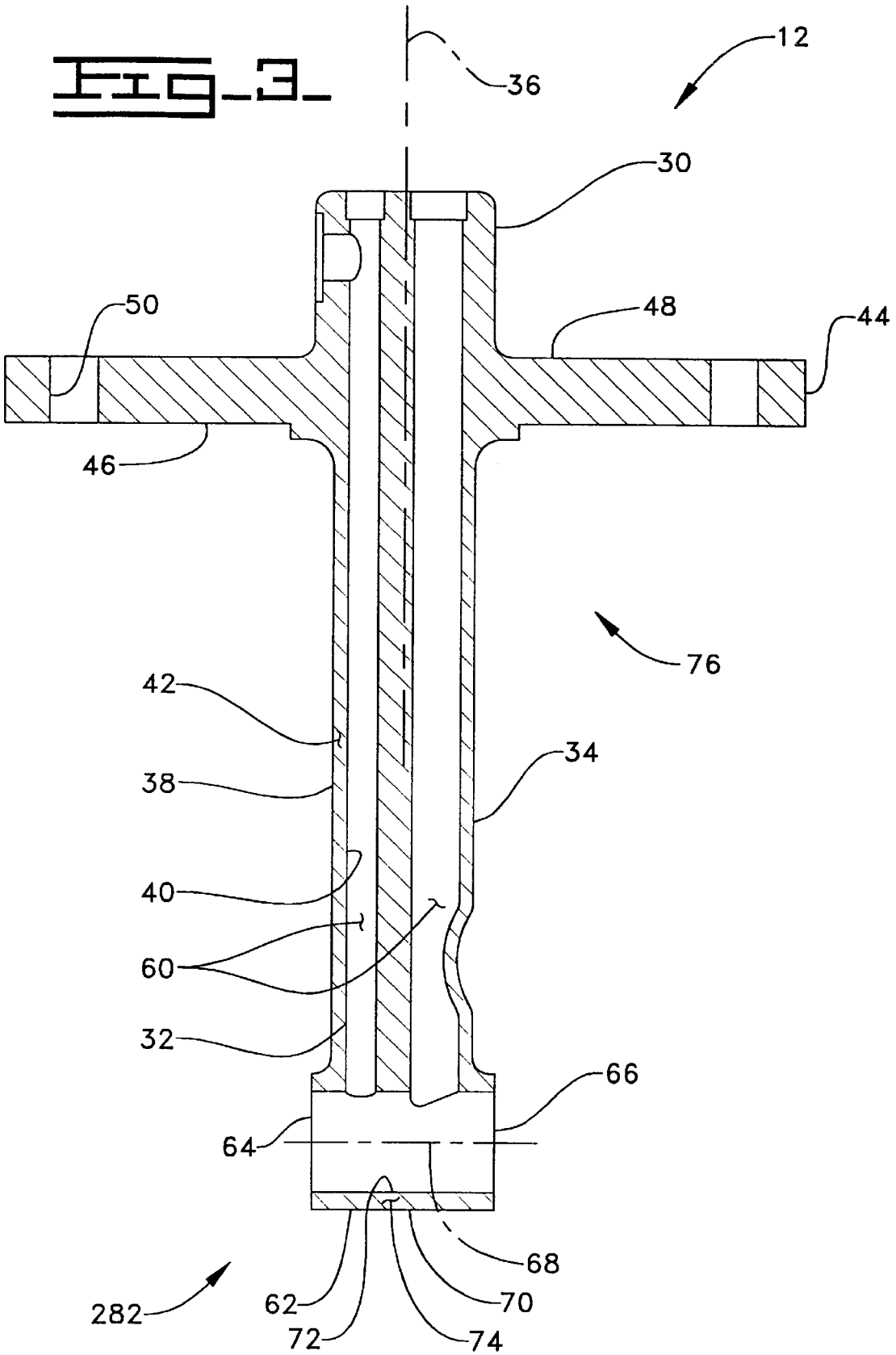
FIG. 3 is a detailed sectional view of a portion of the fuel injector.

Referring to FIG. 1, a gas turbine engine 2 is shown having a compressor section 4, a combustor section 6 and a turbine section 8. A fuel injector 10 is shown communicating with the combustor section 6. As best shown in FIG. 2, the fuel injector 10 has a predetermined fixed configuration and includes a cylindrical portion 12, a nozzle end portion 14, a barrel portion 16 and an inner radial swirler portion 18.

The cylindrical portion 12 includes a first end portion 30 and a second end portion 32. Interposed the first end portion 30 and the second end portion 32 is a generally cylindrical first body portion 34 defining an axis 36. In this application, the first body portion 34 defines a cylindrical outer surface 38 being radially positioned about the axis 36, a cylindrical inner surface 40 being radially positioned about the axis 36 within the outer surface 38. A wall thickness 42 is interposed the outer surface 36 and the inner surface 38. Positioned intermediate the first end portion 30 and the second end portion 32 on the body portion 34 is a mounting portion 44. The mounting portion 44 is connected to the outer surface and has a generally rectangular configuration defining a mounting side 46 and an external side 48. Extending between the mounting side 46 and the external side 48 is a plurality of mounting holes 50, only one shown. Positioned within the inner surface 38 is a pair of fuel passages 60. The fuel passages 60 extend from the extremity of the first end portion 30 to the extremity of the second end portion 32. Positioned at the extremity of the second end portion 32 is a cylindrical second body portion 62 defining a first end 64 and a second end 66 having an axis 68 extending therebetween. The axis 68 of the second body portion 62 is generally perpendicular to the axis 36 of the first body portion 34. In this application, the second body portion 62 defines a cylindrical outer surface 70 being radially positioned about the axis 68 and a cylindrical inner surface 72 being radially positioned about the axis 68 within the outer surface 70. A wall thickness 74 is interposed the outer surface 70 and the inner surface 72. The cylindrical portion 12 is formed as a unitary casting or a first unitary component 76 being a subcomponent of the fuel injector 10. For example, an investment casting technique is use to manufacture the complex structural arrangement. Thus, the wall thickness 42 is controlled and the fuel passages 60 and the first body portion 34 and the second body portion 62 are formed within the first unitary component 76. Additional machining is accomplished to define preestablished critical dimensions and tolerances.

Figure 4:
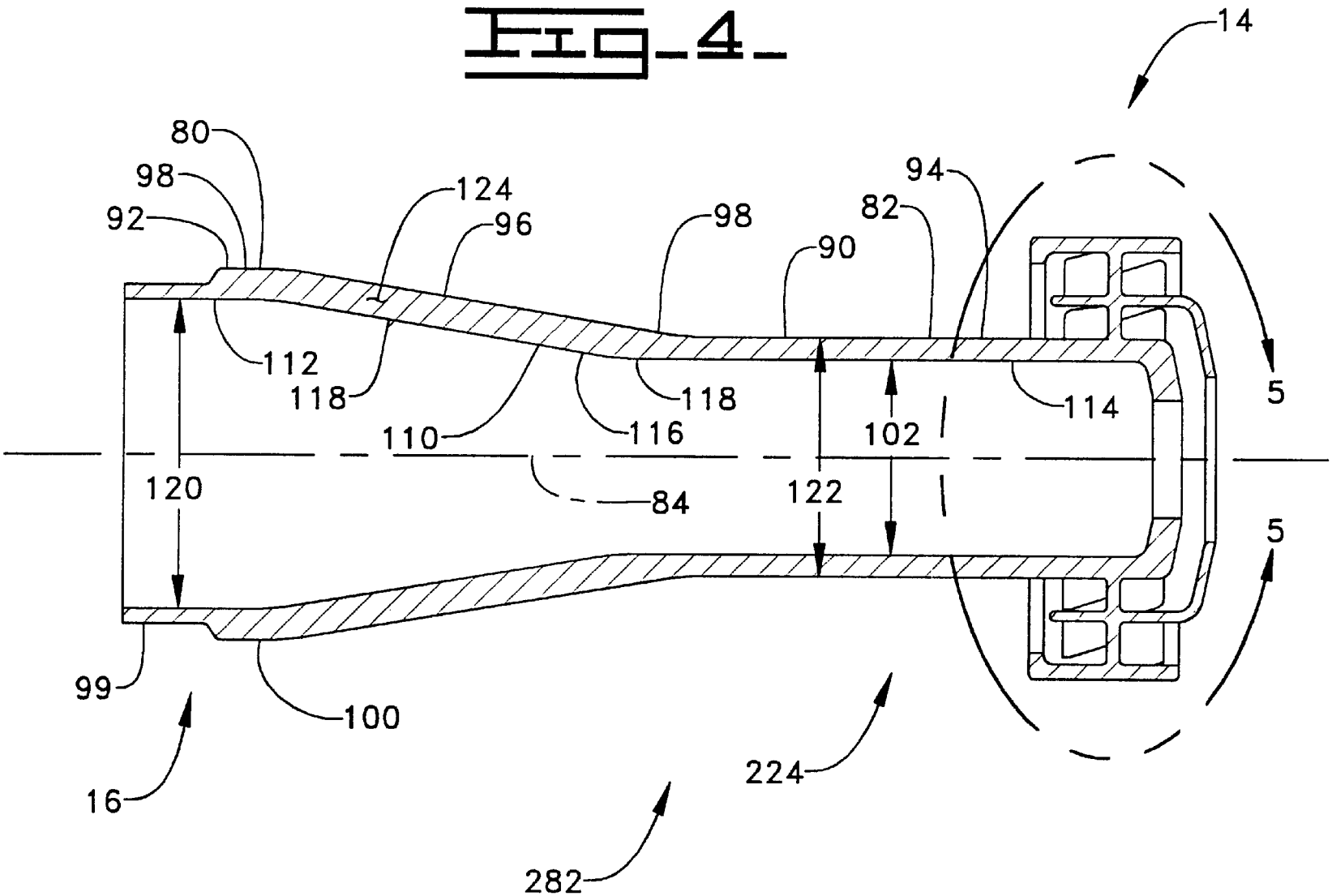
FIG. 4 is a detailed sectional view of a portion of the fuel injector.

In this application and best shown in FIG. 4, the barrel portion 16 defines a first end portion 80 and a second end portion 82 having an axis 84 extending therebetween. Interposed the first end portion 80 and the second end portion 82 is a outer surface 90. The outer surface 90 defines a first axial portion 92 extending from the first end portion 80 toward the second end portion 82. The outer surface 90 defines a second axial portion 94 extending from the second end portion 82 toward the first end portion 80. A transition portion 96 connects the first axial portion 92 with the second axial portion 94. Positioned at the intersection of the first axial portion 92 and the transition portion 96, and the second axial portion 94 and the transition portion 96 is a radiused portion 98. In this application, the first axial portion 92 has a machined diameter 99 and a first diameter 100, and the second axial portion 94 has a second diameter 102 having a preestablished diameter being smaller than that of the first preestablished diameter 100. The barrel portion 16 further includes an inner surface 110 being spaced from the outer surface 90. The inner surface 110 defines a first axial portion 112 extending from the first end portion 80 toward the second end portion 82. The inner surface 110 defines a second axial portion 114 extending from the second end portion 82 toward the first end portion 80. A transition portion 116 connects the first axial portion 92 with the second axial portion 94. Positioned at the intersection of the first axial portion 112 and the transition portion 116, and the second axial portion 114 and the transition portion 116 is a radiused portion 118. In this application, the first axial portion 112 has a first preestablished diameter 120 and the second axial portion 114 has a second preestablished diameter 122. The second preestablished diameter 122 being smaller than that of the first preestablished diameter 120. Formed between the outer surface 90 and the inner surface 110 is a wall thickness 124. In this application, the wall thickness 124 is of a non-uniform dimension. For example, the wall thickness near the first end portion 80 is greater than the wall thickness near the second end portion 82.

Figure 5:
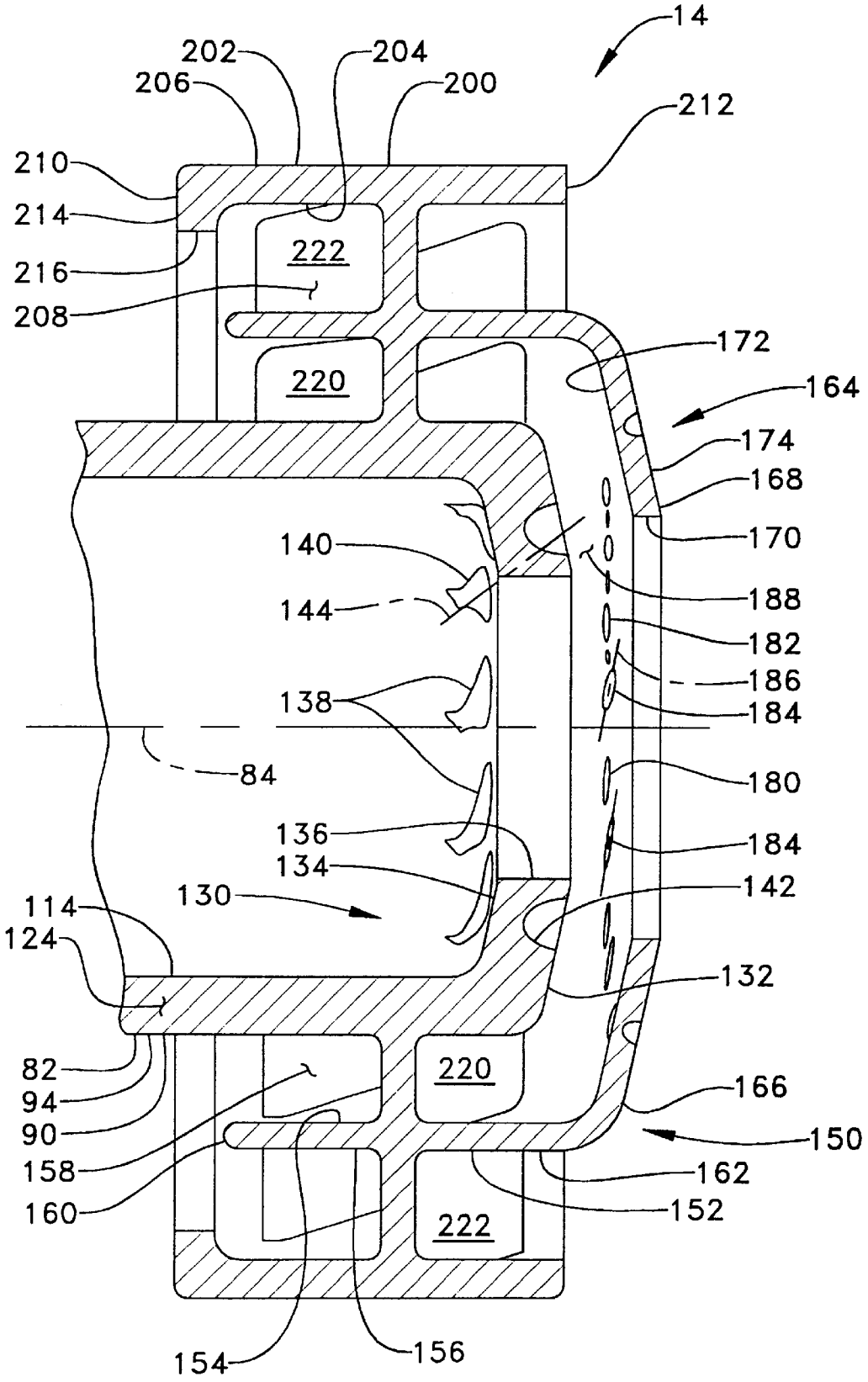
FIG. 5 is an enlarged detailed sectional view of a portion of the fuel injector taken along line 5 of FIG. 4.

Formed at the second end portion 82 of the barrel portion 16 is the nozzle end portion 14. As best shown in FIG. 5, the nozzle end portion 14 is symmetrical about the axis 84 and includes a combustor face portion 130. The combustor face portion 130 includes an outer surface 132 and an inner surface 134. The outer surface 132 is blendingly connected to the second axial portion 94 of the outer surface 90 of the barrel portion 16 and the inner surface 134 is blendingly connected to the second axial portion 114 of the inner surface 110 of the barrel portion 16. A central bore 136 extends between the outer surface 132 and the inner surface 134 of the combustor face portion 130 and defines a preestablished diameter. In this application, a plurality of fuel distribution passages 138 are radially spaced about the axis 84 between the central bore 136 and the second diameter 102 of the second axial portion 94. In this application, the plurality of fuel distribution passages 138 define an inlet end 140 positioned at the inner surface 134 and an outlet end 142 positioned at the outer surface 132. An axis 144 extends along each of the plurality of fuel distribution passages 138 between the inlet end 140 and the outlet end 142. The axis 144 is at an acute angle to the outer surface 132 and is radially spaced about the axis 84. The acute angle, in this application, is in the range of from about 15 to 45 degrees.

The nozzle end portion 14 further includes a hooded portion 150. The hooded portion 150 includes an axial portion 152 defining an inner surface 154 and an outer surface 156. The axial portion 152 is radially spaced about the outer surface 90 of the second axial portion 94 of the barrel portion 16. The axial portion 152 is centered about the axis 84 and forms a passage 158 interposed the inner surface 154 and the outer surface 90 of the second axial portion 82 of the barrel portion 16. The axial portion 152 defines a first end 160 and a second end 162. The first end 160 is positioned toward the transition portion 96 and along the second axial portion 94. The hooded portion 150 further includes a lip portion 164 being spaced from the outer surface 132 of the combustor face portion 130. The lip portion 164 defines a first end 166 being attached to the second end 162 of the axial portion 152 of the hooded portion 150. And, a second end 168 terminates at a bore 170 positioned about the axis 84 and within the lip portion 164. The lip portion 164 is parallel to the outer surface 132 of the combustor end portion 130. Furthermore, the lip portion 164 defines an inner surface 172 being adjacent the outer surface 132 of the combustor end portion 130 and an outer surface 174 spaced from the inner surface 172 a preestablished distance forming a thickness. In this application, the bore 170 is at an angle to the inner surface 172 and the outer surface 174. Located in the lip portion 164 is a first plurality of holes 180 being positioned on a first base circle 182 having a preestablished diameter. Also, located in the lip portion 164 is a second plurality of holes 184 being positioned on a second base circle 186 having a preestablished diameter being larger than the preestablished diameter of the first base circle 182. Each of the second plurality of holes 184 is tangent to the axis 84 and is at an acute angle to the outer surface 174 of the lip portion 164. The acute angle is about 30 degrees and in this application includes 12 evenly spaced holes. Each of the first plurality of holes 180 is at an acute angle of about 30 degrees to the first base circle 182 and about 30 degrees to the outer surface 174 of the lip portion 164. Formed between the inner surface 172 of the lip portion 164 and the outer surface 132 of the combustor face portion 130 is a passage 188 being a continuation of the passage 158 between the axial portion 152 of the hooded portion 150 and second axial portion 94 of the barrel portion 16.

The nozzle end portion 14 further includes an outer shell 200 having an axial portion 202 defining an inner surface 204 and an outer surface 206. The axial portion 202 is radially spaced about the outer surface 156 of the axial portion 152 of the hooded portion 150. The axial portion 202 is centered about the axis 84 and forms a passage 208 interposed the inner surface 204 and the outer surface 156 of the axial portion 152 of the hooded portion 150. The axial portion 202 defines a first end 210 and a second end 212. The first end 210 is positioned toward the transition portion 96 and along the second axial portion 94. The first end 210 has an inwardly radial extension 214 extending therefrom to an inner end 216. The radial extension 214 reduces the size of the inlet to the passage 208; however, the other end of the passage 208 is unrestricted.

Also included in the nozzle end portion 14 is a first plurality of swirlers 220 and a second plurality of swirlers 222. The first plurality of swirlers 220 are positioned within the passage 158 and the second plurality of swirlers 222 are positioned within the passage 208. In this application, the second plurality of swirlers 222 are a radial extension of the first plurality of swirlers 220. Additionally, the first and second plurality of swirlers 220,222 are equally spaced about the respective passages 158,208. The nozzle end portion 14 and the barrel portion 16 are formed as an unitary casting or a second unitary component 224 being a subcomponent of the fuel injector 10. For example, an investment casting technique is use to manufacture the complex structural arrangement. Thus, the non-uniform wall thickness 124 is as cast and complexity of the nozzle end portion 14 is as cast and formed as the second unitary component 224. For example, the plurality of fuel distribution passages 138 in the combustor face portion 130, the first plurality of holes 180 and the second plurality of holes 184 in the hooded portion 150, the passage 188 between the combustor face 130 and the hooded portion 150, the first plurality of swirlers 220 positioned within the passage 158 and the second plurality of swirlers 222 positioned in the passage 208 are formed as the unitary casting or the second unitary component 224. Additional machining is accomplished to define preestablished dimension and tolerances such as the machined diameter 99.

Figure 6:
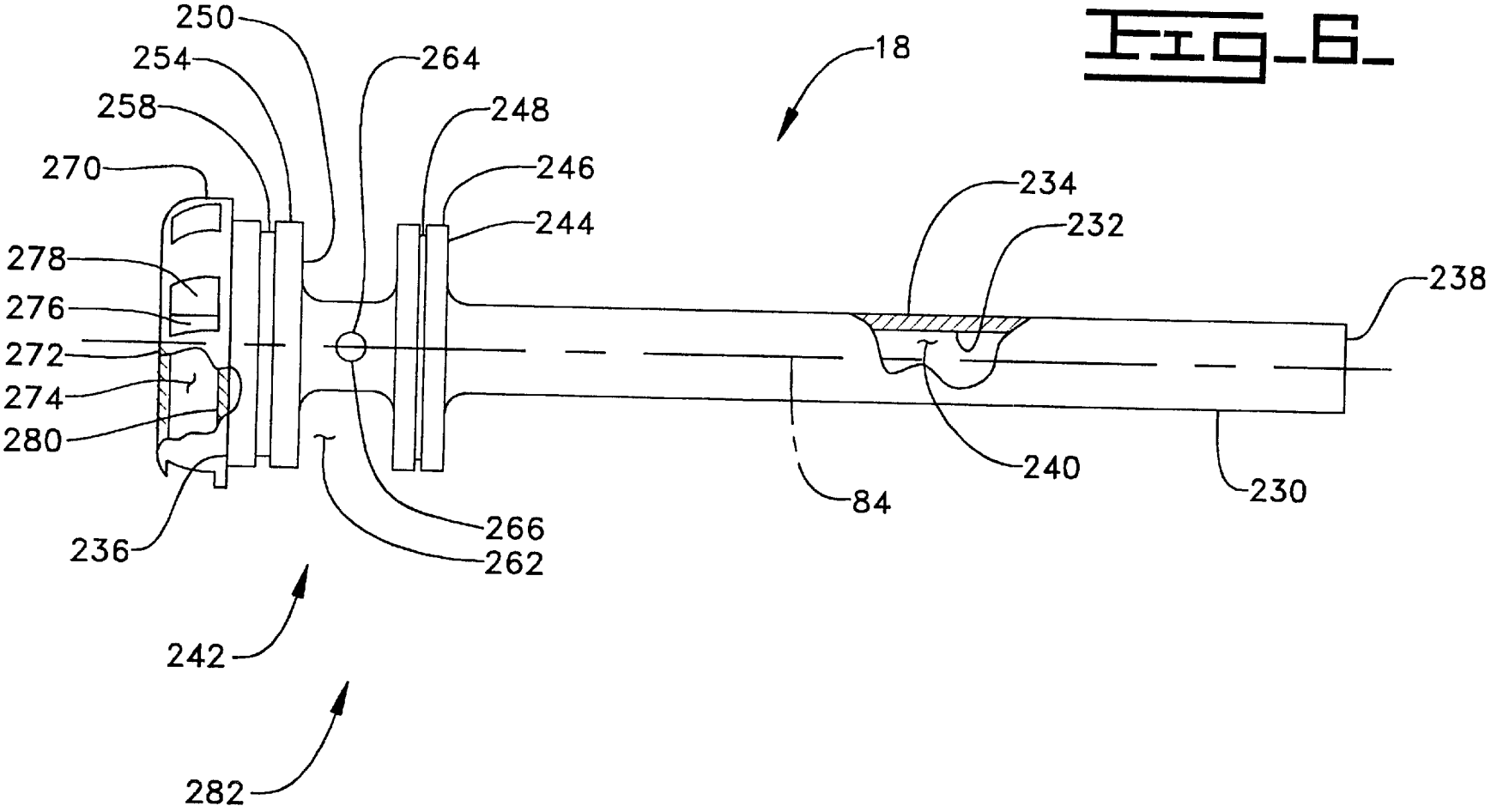
FIG. 6 is a detailed sectional view of a portion of the fuel injector.

As best shown in FIG. 6, the inner radial swirler portion 18 includes a generally cylindrical configuration defining a cylindrical body 230 having an inner surface 232 and an outer surface 234 extending between a first end 236 and a second end 238. A passage 240 is centered about the axis 84 and extends between the first end 236 and the second end 238. A swirler portion 242 is positioned at the first end 236 of the cylindrical body 230. The swirler portion 242 includes a first raised portion 244 extending radially outwardly from the outer surface 234 a preestablished diameter being slightly smaller than the preestablished diameter of the first preestablished diameter 120 of the first axial portion 112. The first raised portion 244 is positioned between the first end 236 and the second end 238 and defines an outer extremity 246 having a preestablished width. A radial groove 248 having a preestablished configuration is positioned in the outer extremity 246. In the assembled condition, a first sealing member 250 is positioned in the radial groove 248. A second raised portion 252 extends radially outwardly from the outer surface 234 a preestablished diameter being slightly smaller than the preestablished diameter of the first preestablished diameter 120 of the first axial portion 112. The second raised portion 252 is positioned between the first raised portion 244 and the second end 238. The second raised portion 252 defines an outer extremity 254 having a preestablished width. A radial groove 258 having a preestablished configuration is positioned in the outer extremity 254. In the assembled condition, a second sealing member 260 is positioned in the radial groove 258.

A radial cavity 262 is formed between the first radial portion 244 and the second radial portion 252. A passage 264 communicates between the radial cavity 262 and the passage 240. The Passage 264 is at an angle to the axis 84. For example, an inlet end 266 of the passage 264 is positioned on the outer surface 234 of the body 230 within the radial cavity 262 and an outlet end, not shown, is positioned on the inner surface 232 of the body 230 within the passage 240. Furthermore, the inlet end 266 is positioned near the first end 236 of the body 230 and the outlet end is positioned intermediate the inlet end 266 and the second end 238 of the body 230. Attached to the first end 236 of the body 230 is a radial swirler 270. The radial swirler 270 includes a plate member 272 being spaced from the first end 232 of the body 230 and forms a passage 274. A plurality of radial swirler members 276 are positioned in the passage 274. The passage 274 defines an inlet portion 278 being positioned generally in radial alignment with the outer extremity 246 of the second radial portion 252 but being slightly larger than the first diameter 100 of the first axial portion 92. An outlet portion 280 of the passage 274 is in communication with the passage 240. The outlet portion 280 and the passage 240 are blendingly connected. The inner radial swirler portion 18 is formed as an unitary casting or a third unitary component 282 being a subcomponent of the fuel injector 10. For example, an investment casting technique is use to manufacture the complex structural arrangement. For example, the passage 240, the radial groove 248, the radial groove 258, the radial cavity 262, the passage 274, and the plurality of radial swirler members 276 positioned in the passage 274 are formed as the unitary casting or the third unitary component 282. Additional machining can be accomplished to define preestablished dimension and tolerances.

As stated above, each of the cylindrical portion 12, the nozzle end portion 14 and the barrel portion 16, and the inner radial swirler portion 18 are made as an individual unitary casting and include the first unitary component 76, the second unitary component 224, and the third unitary component 282. In most instances, the detailed configuration is as cast. As an alternative, other configurations could be incorporated as cast or as a separate machining parameter without changing the jest of the invention. Additionally, other manufacturing process could be used to economically make the unitary components 76,224,282.

Other aspects, objects and advantages of this invention can be obtained from a study of the drawings, the disclosure and the appended claims.

Industrial Applicability

As best shown in FIGS. 1 and 2, the fuel injector 10 is in the assembled condition. The finished assembly of the fuel injector 10 includes the following steps. After the first unitary component 76 has been formed by the investment casting process, any additional machining is competed. For example, threaded holes are machined to communicate the pair of fuel passages 60 with fitting or adapters positioned within the threaded holes. Thus, the pair of fuel passages 60 can be connected to the source of fuel. Next, the first end portion 80 of the second unitary component 224 is positioned in the first end portion 64 of the second body portion 62. Prior to positioning the third unitary component 224 the second seal member 260 is positioned in the radial groove 258 and the first seal member 250 is positioned in the radial groove 248. And, next, the third unitary component 282 is positioned in the first unitary component 76 and the second unitary component 224. For example, the second end 238 of the inner radial swirler portion 18 is inserted into the second end 66 of the second body portion 62. The second end 238 is extended through the second body portion 62 and into the nozzle end portion 14. The passage 240 at the second end 238 is axially aligned with the central bore 136 and is spaced from or short of the inner surface 134. The inner radial swirler portion 18 is radially positioned by the first seal member 250 and the second seal member 260 being in contacting relationship with the inner surface 72 of the second body portion 62. Additionally, the first end 236 of the cylindrical body 230 is aligned with the first end 64 of the second body portion 62. And, the radial swirler 270 abuts the first end 64 of the second body portion 62. Thus, the radial cavity 262 is in sealing communication with one of the pair of fuel passages 60.

Thus, the manufacturing of complex fuel injectors 10 has been improved. For example, the labor intensive positioning and arranging of individual parts is essentially eliminated. The multiplicity of furnace or brazing operation is eliminated or reduced and the accuracy of the final assembly is improved and more consistent. This results in a fuel injector 10 having more consistent operating parameters, such as emissions and mixing characteristics. In addition to the above advantages these new fuel injectors 10 provide a cost savings, reduce lead time and servicing intervals.

Other aspects, objects and advantages will become apparent from a study of the specification, drawings and appended claims.

We claim:

1. A fuel injector being adapted for use with a gas turbine engine; said fuel injector comprising:

a first unitary component defining a first body portion having a mounting portion thereon and a fuel passage positioned therein;

a second unitary component defining a barrel portion having a first end portion and a second end portion, said first end portion being fixedly attached to said first unitary component and said second end portion having a nozzle end portion formed as a unitary portion of said second unitary component, said nozzle end portion defining a combustor face portion having a plurality of fuel distribution passages therein and a plurality of swirlers being positioned about said combustor face portion; and a third unitary component defining a cylindrical body having a first end and a second end, a passage extending between said first end and said second end, a first raised portion being positioned between said first end and a second end and a second raised portion is positioned between said first raised portion and said second end, a cavity is formed between said first radial portion and said second radial portion, said cavity being in communication with said passage of said third unitary component and said fuel passage of said first unitary component, and said third unitary component being fixedly attached to said first unitary component.

2. The fuel injector of claim 1 wherein each of said first unitary component, said second unitary component and said third unitary component are made as an individual castings.

3. The fuel injector of claim 2 wherein said castings are each made as an investment casting.

4. The fuel injector of claim 1 wherein said first unitary component includes said first body portion and a second body portion, said second body portion being attached to a second end portion of said first body portion.

5. The fuel injector of claim 4 wherein said first body portion includes an axis and said second body portion includes an axis, said axis of said first body portion being perpendicular to said axis of said second body portion.

6. The fuel injector of claim 1 wherein said barrel portion includes a wall thickness being of a non-uniform thickness.

7. The fuel injector of claim 6 wherein said non-uniform thickness near said first end portion is greater than said non-uniform thickness near said second end portion.

8. The fuel injector of claim 1 wherein said barrel portion includes an axis and said passage of said cylindrical body is centered about said axis.

9. The fuel injector of claim 8 wherein said barrel portion further includes a first end portion and a second end portion having a bore extending therebetween, said second end of said cylindrical body is spaced from said inner surface and said passage is axially aligned with said bore.

10. The fuel injector of claim 1 wherein said cylindrical body includes a swirler portion positioned at said first end.

11. The fuel injector of claim 10 wherein said first unitary component includes a first body portion and a second body portion, said second body portion having a first end and a second end, said swirler portion of said third unitary component being positioned at said first end of said second body portion.

12. A method of making a fuel injector, said method of making including the steps of:

manufacturing a first unitary component defining a body portion defining an axis and having a mounting portion positioned thereon and a fuel passage positioned therein, and a method of manufacturing said first unitary component being a casting process;

manufacturing a second unitary component defining a barrel portion having a first end portion and a second end portion, an axis extending between said first end portion and said second end portion, and said second end portion having a nozzle end portion attached thereto, said nozzle end portion defining a combustor face portion having a plurality of fuel distribution passages therein and a plurality of swirlers being positioned about said combustor face portion, and a method of manufacturing said second unitary component being a casting process;

manufacturing a third unitary component defining a cylindrical body having a first end and a second end, a passage extending between each of said first end and said second end, a first raised portion being positioned between said first end and a second raised portion being positioned between said first raised portion and said second end, a cavity being formed between said first radial portion and said second radial portion, said cavity being in communication with said passage, and a method of manufacturing said third unitary component being a casting process; and attaching said first unitary component, said second unitary component and said third unitary component into said fuel injector having a predetermined fixed configuration.

13. The method of making a fuel injector of claim 12 wherein said step of manufacturing a first unitary component and said method of manufacturing being said casting process including a first body and a second body portion defining a first end and a second end having an axis extending between said first end and said second end and said axis of said first body portion being generally perpendicular to said axis of said second body portion being in the as cast condition.

14. The method of making a fuel injector of claim 12 wherein said step of manufacturing a second unitary component and said method of manufacturing being said casting process including said nozzle end portion having a hood portion forming a passage between said hood portion and said combustor end portion being generally free of machining and in the as cast condition.

15. The method of making a fuel injector of claim 14 wherein said step of manufacturing said second unitary component and the method of manufacturing being said casting process including said hood portion having a plurality of holes being generally free of machining and in the as cast condition.

16. The method of making a fuel injector of claim 14 wherein said step of manufacturing said second unitary component and said method of manufacturing being said casting process including said plurality of swirlers having a first plurality of swirlers being positioned between said hood portion and said combustor face portion being generally free of machining and in the as cast condition.

17. The method of making a fuel injector of claim 16 wherein said step of manufacturing said second unitary component and said method of manufacturing being said casting process including said plurality of swirlers having a second plurality of swirlers being positioned between said hood portion and an outer shell being generally free of machining and in the as cast condition.

18. The method of making a fuel injector of claim 12 wherein said step of manufacturing said third unitary component and said method of manufacturing being said casting process including said cylindrical body having a swirler portion, being positioned at said first end of said cylindrical body being generally free of machining and in the as cast condition.

19. The method of making a fuel injector of claim 18 wherein said step of manufacturing said third unitary component and said method of manufacturing being said casting process including said swirler portion defining a passage having a plurality of swirler members positioned therein, said passage being in communication with said passage in said cylindrical body being generally free of machining and in the as cast condition.

20. The method of making a fuel injector of claim 12 wherein said step of attaching said first unitary component, said second unitary component and said third unitary component includes positioning said second unitary component within said first unitary component and being in contacting relationship therewith, and positioning said third unitary component within said first unitary component and having said passage of said third unitary component centered about said axis and being in contacting relationship therewith.

21. The method of making a fuel injector of claim 20 wherein said step of attaching said first unitary component, said second unitary component and said third unitary component includes the process of welding of said unitary components and fixedly maintaining said contacting relationships.

22. The method of making a fuel injector of claim 21 wherein said step of attaching said first unitary component, said second unitary component and said third unitary component includes said first raised portion and said second raised portion centering said passage about said axis.

23. The method of making a fuel injector of claim 22 wherein said step of attaching said first unitary component, said second unitary component and said third unitary component includes communication between said cavity and said fuel passage.

24. The method of making a fuel injector of claim 23 wherein said step of attaching said first unitary component, said second unitary component and said third unitary component includes said second end being spaced from said combustor face portion.

25. A fuel injector comprising:

a first unitary component being manufactured by a casting process;

a second unitary component being manufactured by a casting process;

a third unitary component being manufactured by a casting process; and said second unitary component being positioned within said first unitary component, said third unitary component being positioned within said first unitary component and said second unitary component being fixedly attached by a welding process to said first unitary component and said third unitary component being fixedly attached to said first unitary component.

* * * * *